US011413897B2

(12) United States Patent
Takeda et al.

(10) Patent No.: US 11,413,897 B2
(45) Date of Patent: Aug. 16, 2022

(54) INKJET RECORDING MEDIUM

(71) Applicant: CANON KABUSHIKI KAISHA, Tokyo (JP)

(72) Inventors: Shoichi Takeda, Yokohama (JP); Tetsuro Noguchi, Hachioji (JP); Kazuhiko Araki, Kawasaki (JP); Hiroo Miyamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/867,300

(22) Filed: May 5, 2020

(65) Prior Publication Data

US 2020/0353767 A1 Nov. 12, 2020

(30) Foreign Application Priority Data

May 10, 2019 (JP) ..... JP2019-089720

(51) Int. Cl.
*B41M 5/50* (2006.01)
*B41M 5/52* (2006.01)

(52) U.S. Cl.
CPC ..... *B41M 5/502* (2013.01); *B41M 5/506* (2013.01); *B41M 5/508* (2013.01); *B41M 5/5218* (2013.01); *B41M 5/5227* (2013.01); *B41M 5/5272* (2013.01); *B41M 5/5281* (2013.01)

(58) Field of Classification Search
CPC ..... B41M 5/502; B41M 5/506; B41M 5/508; B41M 5/5218; B41M 5/5227; B41M 5/5272; B41M 5/5281
USPC ..... 428/32.34
See application file for complete search history.

(56) References Cited

U.S. PATENT DOCUMENTS

| | | | | |
|---|---|---|---|---|
| 4,202,870 | A | 5/1980 | Caglione et al. | |
| 4,242,271 | A | 12/1980 | Hill | |
| 4,434,226 | A | 2/1984 | Wilgus et al. | |
| 2002/0176970 | A1* | 11/2002 | Kobayashi | B41M 5/52 428/32.3 |
| 2003/0124273 | A1* | 7/2003 | Jung | B41M 5/506 428/32.1 |
| 2007/0202264 | A1* | 8/2007 | Ruschak | B41M 5/508 427/407.1 |
| 2020/0353767 | A1* | 11/2020 | Takeda | B41M 5/502 |

FOREIGN PATENT DOCUMENTS

| | | | |
|---|---|---|---|
| JP | S57-44605 | B2 | 9/1982 |
| JP | S61-10483 | A | 1/1986 |
| JP | H05-16015 | B2 | 3/1993 |
| JP | H07-232473 | A | 9/1995 |
| JP | H08-132731 | A | 5/1996 |
| JP | H09-66664 | A | 3/1997 |
| JP | H09-76628 | A | 3/1997 |
| JP | H11-334224 | A | 12/1999 |
| JP | 2001-341421 | A | 12/2001 |
| JP | 2004-237664 | A | 8/2004 |

* cited by examiner

*Primary Examiner* — Betelhem Shewareged
(74) *Attorney, Agent, or Firm* — Canon U.S.A., Inc., IP Division

(57) ABSTRACT

An inkjet recording medium includes a substrate having a resin layer, a bonding layer disposed on the resin layer, and an ink-receiving layer disposed on the bonding layer. The surface of the inkjet recording medium on the ink-receiving layer side of the inkjet recording medium has a 20° glossiness of 13.0 or more. The bonding layer contains an ultraviolet inhibitor at a content of 5.0% by mass or more and 35.0% by mass or less based on the total mass of the bonding layer.

15 Claims, No Drawings

INKJET RECORDING MEDIUM

BACKGROUND OF THE INVENTION

Field of the Invention

The present disclosure relates to an inkjet recording medium.

Description of the Related Art

Among inkjet recording media for recording an image by an inkjet recording method, a recording medium for recording a photograph image is required to be capable of recording an image with high optical density and excellent image clarity. However, in a recording medium using cellulose-based paper as a substrate, the image clarity of an image may become insufficient due to unevenness caused by the formation of paper. On the other hand, since a recording medium using a plastic film such as a polyester film or a film obtained by laminating a plastic film and other layers as a substrate has a smooth surface, an image with good image clarity and excellent glossiness can be recorded thereon.

For example, there has been proposed a substrate for a thermal transfer receiving sheet in which a film layer forming of a resin containing polyolefin as a main component is laminated on the surface of a cellulose core layer having a coating layer with a maximum surface roughness of 7.0 μm or less (Japanese Patent Application Laid-Open No. H11-334224). In addition, there has been proposed inkjet media having an overcoat layer provided on the surface of an aqueous ink-receiving layer after performing inkjet recording on a recording medium provided with a PET film substrate, a water-resistant anchor coat layer, and the aqueous ink-receiving layer (Japanese Patent Application Laid-Open No. 2004-237664). Furthermore, there has been proposed a recording medium for inkjet recording in which a light fastness imparting layer containing an ultraviolet absorber and an image forming layer are laminated on a substrate (Japanese Patent Application Laid-Open No. 2001-341421).

SUMMARY OF THE INVENTION

The present disclosure is directed to providing an inkjet recording medium capable of recording an image with excellent coloring property and light fastness, and with excellent image clarity and cutting processability.

According to an aspect of the present disclosure, there is provided an inkjet recording medium including a substrate having a resin layer, a bonding layer disposed on the resin layer, and an ink-receiving layer disposed on the bonding layer, in which 20° glossiness of a surface of the inkjet recording medium on the ink-receiving layer side is 13.0 or more, the bonding layer contains an ultraviolet inhibitor, and a content (% by mass) of the ultraviolet inhibitor in the bonding layer is 5.0% by mass or more and 35.0% by mass or less based on a total mass of the bonding layer.

Further features of the present disclosure will become apparent from the following description of exemplary embodiments.

DESCRIPTION OF THE EMBODIMENTS

In a recording medium provided with the substrate proposed in Japanese Patent Application Laid-Open No. H11-334224, image clarity easily decreases due to unevenness of the surface of a cellulose core layer. In addition, in the inkjet media proposed in Japanese Patent Application Laid-Open No. 2004-237664, since the amount of light reflected from a substrate increases, light fastness of a recorded image is easily reduced, and the ink-receiving layer is easily chipped during cutting, as compared to a recording medium using paper as a substrate. In addition, in the recording medium proposed in Japanese Patent Application Laid-Open No. 2001-341421, it is difficult to record an image with high optical density and excellent coloring property.

Therefore, the present inventors have conducted intensive studies to improve the coloring property, light fastness, image clarity, and cutting processability of the inkjet recording medium, and have reached the present disclosure.

Hereinafter, the present disclosure will be described in more detail with reference to an exemplary embodiment. The image clarity of the recording medium can be improved by increasing the surface glossiness of the recording medium on the ink-receiving layer side. Specifically, a recording medium with excellent image clarity can be obtained by setting 20° glossiness of the surface on the ink-receiving layer side to 13.0 or more. Here, in order to make the 20° glossiness of the surface on the ink-receiving layer side 13.0 or more, it is necessary to smooth the surface of a resin layer on which the ink-receiving layer is disposed. However, when the surface of the resin layer is smoothed, the amount of light incident from the surface of the ink-receiving layer and reflected by the resin layer increases, and the amount of light exposure to the color material in the image formed on the ink-receiving layer increases. Therefore, an image recorded on a recording medium having an ink-receiving layer disposed on a resin layer is likely to have lower light fastness than an image recorded on a recording medium having an ink-receiving layer disposed on paper. In addition, when the surface of the resin layer is smooth, the anchor effect is less likely to be exerted, so that the adhesion between the resin layer and the ink-receiving layer is reduced, and the ink-receiving layer is easily chipped during cutting.

The present inventors have found that the coloring property and light fastness of an image to be recorded are improved, the adhesion between the resin layer and the ink-receiving layer is improved by adopting the following constitutions (i) and (ii), and the image clarity can be improved, and have completed the present disclosure.

(i) A bonding layer containing an ultraviolet inhibitor is disposed between a resin layer and an ink-receiving layer.

(ii) The content (% by mass) of the ultraviolet inhibitor in the bonding layer is set to 5.0% by mass or more and 35.0% by mass or less based on the total mass of the bonding layer.

By the way, in order to improve the light fastness of an image, it is conceivable to contain an ultraviolet inhibitor in the ink-receiving layer. However, when an ultraviolet inhibitor is contained in the ink-receiving layer, the transparency of the ink-receiving layer is reduced, and the coloring property of an image is easily reduced. For this reason, it is preferable that the ink-receiving layer does not substantially contain an ultraviolet inhibitor. Specifically, the content (% by mass) of the ultraviolet inhibitor in the ink receiving layer is preferably 1% by mass or less, more preferably 0% by mass based on the total mass of the ink receiving layer.

<Inkjet Recording Medium>

The inkjet recording medium of the present disclosure (hereinafter, also simply referred to as "recording medium") is an inkjet recording medium for inkjet recording including a substrate having a resin layer, a bonding layer disposed on the resin layer, and an ink-receiving layer disposed on the bonding layer. The 20° glossiness of the surface of the recording medium on the ink-receiving layer side is 13.0 or more, and the bonding layer contains an ultraviolet inhibitor. The content (% by mass) of the ultraviolet inhibitor in the bonding layer is 5.0% by mass or more and 35.0% by mass or less based on the total mass of the bonding layer. Here, the 20° glossiness of the surface of the recording medium on the ink-receiving layer side is preferably 30.0 or more, more preferably 40.0 or more, and still more preferably 45.0 or more. In addition, the upper limit of the 20° glossiness of the surface of the recording medium on the ink-receiving layer side is 100.0 or less. Hereinafter, each component constituting the recording medium of the present disclosure will be described.

(Substrate)

A substrate constituting the inkjet recording medium of the present disclosure has a resin layer. The substrate may be a resin layer alone, or may have a base paper and a resin layer laminated on the base paper. When a laminate of a base paper and a resin layer is used as a substrate, a bonding layer is disposed on one surface of the resin layer, and the base paper is disposed on the other surface (opposite surface).

[Base Paper]

As the base paper, a sheet-like base paper containing pulp can be used. As the pulp, natural pulp, regenerated pulp, synthetic pulp, and the like can be used alone or in combination of two or more. In addition to the pulp, the base paper may contain additives generally used in papermaking, such as a sizing agent, a paper strength enhancer, a filler, an antistatic agent, a fluorescent brightener, and a dye. The surface of the base paper may be coated with a surface sizing agent, a surface paper strength agent, a fluorescent brightener, an antistatic agent, a dye, an anchoring agent, and the like.

The average surface roughness (Ra) of the base paper is preferably 1.0 μm or less, more preferably 0.5 μm or less, still more preferably 0.45 μm or less, and particularly preferably 0.4 μm or less. By setting the average surface roughness (Ra) of the base paper within the above range, unevenness on the surface of the substrate can be suppressed. The lower limit of the average surface roughness (Ra) of the base paper is not particularly limited. Specifically, the average surface roughness (Ra) of the base paper is preferably 0 μm or more and 0.5 μm or less.

The thickness of the base paper is preferably 50 μm or more and 250 μm or less, more preferably 80 μm or more and 200 μm or less, and particularly preferably 90 μm or more and 150 μm or less from the viewpoint of rigidity or the like. The thickness of the base paper can be calculated according to the following method. First, a cross section of a recording medium cut out by a microtome is observed with a scanning electron microscope. Then, the thicknesses of any 100 or more points of the base paper are measured, and the average value is defined as the thickness of the base paper. The thickness of the layer (film) other than the base paper is also calculated in the same method.

From the viewpoint of surface smoothness, the base paper is preferably a base paper which has been subjected to a surface treatment such as being compressed by applying pressure by calendering or the like during or after papermaking. The paper density of the base paper specified in JIS P 8118:2014 is preferably 0.6 g/cm$^3$ or more and 1.2 g/cm$^3$ or less, and more preferably is 0.7 g/cm$^3$ or more and 1.2 g/cm$^3$ or less.

The base paper preferably has a coating layer formed on the surface of the base paper from the viewpoint of smoothness. The coating layer contains, for example, an adhesive and a pigment to be blended if necessary. As the adhesive, for example, an emulsion of a polymer or copolymer such as a styrene-butadiene copolymer, a methyl methacrylate-styrene-butadiene copolymer, a vinyl acetate resin, or an acrylic resin can be used alone or in combination of two or more. Further, a water-soluble polymer adhesive such as polyvinyl alcohol, starch, or casein can be used. Alternatively, a polymer adhesive soluble in an organic solvent such as toluene can be used.

Examples of the pigment include white pigments such as various clays such as kaolin, calcium carbonate, titanium dioxide, aluminum hydroxide, satin white, talc, calcium sulfite, calcined clay, finely powdered silica, and organic fillers, which are generally used for coated paper for printing and the like. The coating layer may appropriately contain an antifoaming agent, a dispersant, a conductive agent, a wetting agent, and the like.

When a coating layer is formed on the surface of the base paper, the average surface roughness (Ra) of the coating layer is preferably adjusted to 0.5 μm or less by a smoothing treatment such as a super calendering treatment or a cast finish.

[Resin Layer]

As the resin layer (hereinafter, also referred to as "film layer"), it is preferable to use a stretched film with excellent smoothness. By forming the resin layer with the stretched film, the surface of the substrate can be made smooth. The resin layer may be disposed on only one surface of the base paper, or may be disposed on both surfaces. The thickness of the resin layer is preferably 70 μm or more, more preferably 80 μm or more and 200 μm or less, still more preferably 85 μm or more and 150 μm or less, and particularly preferably 90 μm or more and 130 μm or less. When the thickness of the resin layer is 70 μm or more, the influence of the unevenness of the base paper surface on the shape of the substrate surface can be suppressed. By using the substrate in which the influence of the unevenness of the base paper surface is suppressed, the unevenness of the surface of the ink-receiving layer can also be suppressed, and the image clarity of the recording medium can be further improved while maintaining the texture of the paper. When a resin layer such as a stretched film is directly used as a substrate, the thickness of the resin layer is preferably 70 μm or more and 300 μm or less, and more preferably 100 μm or more and 300 μm or less.

The resin layer may be transparent or opaque. The resin layer may be colored. That is, the resin layer may contain a coloring agent such as a pigment. The resin layer may include voids. The resin layer may have a multilayer structure. As the stretched film for forming the resin layer, a uniaxially stretched resin film or a biaxially stretched resin film can be used. More specifically, a stretched resin film having a stretch ratio of 2 times or more and 10 times or less in each of a vertical direction and a horizontal direction is preferable.

As a constituent material of the resin layer, a thermoplastic resin can be used. Examples of the thermoplastic resin include polyethylene, polyvinyl chloride, polystyrene, an acrylonitrile.styrene resin (AS resin), an acrylonitrile.butadiene.styrene resin (ABS resin), polypropylene, a polymethyl methacrylate resin (PMMA), and polyethylene terephthalate (PET). The resin layer may contain inorganic fine particles, organic fine particles, a fluorescent brightener, and the like in order to adjust the whiteness. The resin layer may contain additives such as an antistatic agent, a heat stabilizer, an antioxidant, an ultraviolet inhibitor, a light stabilizer, a softener, and an anti-slip agent.

As the stretched film for forming the resin layer, a biaxially stretched polyester film is preferable. The biaxially stretched polyester film has relatively high heat resistance, and has little thermal deformation at the time of bonding with the base paper or at the time of forming the ink-receiving layer, so that the smoothness can be improved.

From the viewpoint of glossiness of the surface of the recording medium, the 20° glossiness of the surface of the substrate (the surface of the resin layer) is preferably 25.0 or more, more preferably 30.0 or more, and particularly preferably 35.0 or more. When the 20° glossiness of the surface of the substrate is less than 25.0, the image clarity of the recording medium may slightly decrease. The upper limit of the 20° glossiness of the surface of the substrate is 100.0 or less.

Further, image clarity of a recording medium may be influenced, not only by glossiness, but also by minute structure of the surface of the recording medium, which is not visible as a difference of glossiness. Such surface minute structure of the recording medium is formed primarily by the minute surface structure of the resin layer underlying the ink-receiving layer. The minute surface structure of the resin layer can be measured by a DOI (Distinctness of Image) measuring device. The DOI measuring device is configured to irradiate the surface to be measured with laser light emitted from a point source of laser light obliquely by an angle of 60° from the normal to the surface to be measured and detect light-and-dark of the reflected light appearing on the opposite side relative to the normal by the same angle by means of a detector one by one at predetermined intervals to determine the optical profile of the surface of the specimen.

Among these surface structures of the resin layer, structures having a size of 0.3 to 1 mm are easily recognizable as image clarity because such size is close to the resolution of the human eye. Therefore, in the present disclosure, characteristic spectrum Wb value measured within a wavelength range of 0.3 to 1 mm by the DOI measuring device is selectively used. Specifically, from the viewpoint of image clarity of a recording medium, the Wb value of the surface of the resin layer on the bonding layer side measured by the DOI measuring device is preferably 23 or less, more preferably 15 or less. Further, the lower limit of the Wb value of the surface of the resin layer on the bonding layer side measured by the DOI measuring device is zero or more. The Wb value of the resin layer can be measured by the DOI measuring device directly from the resin layer before it is formed into a recording medium. Otherwise, the Wb value can also be measured from the manufactured recording medium by removing the ink-receiving layer. That is, the ink-receiving layer is removed from the recording medium by using water and then the Wb value of the surface of the bonding layer after removal of the ink-receiving layer is measured by the DOI measuring device. Since the Wb value of the bonding layer surface is nearly the same as the Wb value of the resin layer surface, the Wb value of the bonding layer can be regarded as the Wb value of the resin layer surface.

[Intermediate Layer]

In order to improve the adhesiveness of the resin layer to the base paper, it is preferable to provide an intermediate layer between the base paper and the resin layer. Examples of a method of bonding a resin layer such as a stretched film to a base paper include a dry laminating method, a method of bonding through a double-sided pressure-sensitive adhesive sheet, and an extrusion sandwich lamination method. Among them, it is preferable to bond a resin layer such as a stretched film to the base paper by the extrusion sandwich lamination method because the smoothness can be further improved.

The intermediate layer is preferably formed of a resin having adhesiveness. As the resin forming the intermediate layer, a polyolefin is preferable from the viewpoint of productivity and cost. The term "polyolefin" in the present specification refers to a polymer obtained by using an olefin as a monomer. Specific examples of the polyolefin include a homopolymer and a copolymer of ethylene, propylene, isobutylene, and the like. Among them, polyethylene such as low density polyethylene (LDPE) and high density polyethylene (HDPE) is preferable. The density of the polyolefin is preferably 0.85 g/cm$^3$ or more and 0.98 g/cm$^3$ or less, and more preferably is 0.90 g/cm$^3$ or more and 0.95 g/cm$^3$ or less.

The thickness of the intermediate layer is preferably 5 μm or more and 100 μm or less, and more preferably 10 μm or more and 60 μm or less. When the intermediate layer is formed of polyolefin, the lower the melting point of polyolefin is, the lower the laminating temperature can be, and the heat shrinkage of the resin layer can be more suppressed. As a result, curling of the substrate can be suppressed. The melting point of the polyolefin is preferably 80° C. or higher to 160° C. or lower, and more preferably 95° C. or higher to 140° C. or lower.

As the resin forming the intermediate layer, a polyolefin and a thermoplastic resin other than the polyolefin can be used in combination. Examples of the thermoplastic resin other than the polyolefin include a polystyrene resin, a polyester resin such as polyethylene terephthalate, a nylon resin, and a polyurethane resin. The intermediate layer may contain inorganic fine particles, organic fine particles, a fluorescent brightener, and the like in order to adjust the whiteness. The intermediate layer may contain additives such as an antistatic agent, a heat stabilizer, an antioxidant, an ultraviolet inhibitor, and a light stabilizer.

[Back Surface Resin Layer]

When the resin layer is disposed only on one surface of the base paper, it is preferable to provide a back surface resin layer on the other surface (back surface) of the base paper from the viewpoint of suppressing curling of the substrate. As the resin forming the back surface resin layer, a thermoplastic resin is preferable. Examples of the thermoplastic resin include an acrylic resin, an acrylic silicone resin, a polyolefin resin, and a styrene-butadiene copolymer, and among them, a polyolefin resin is preferable. Examples of the polyolefin resin include polyethylene and polypropylene, and among them, polyethylene such as low density polyethylene (LDPE) and high density polyethylene (HDPE) is preferable. The thickness of the back surface resin layer is preferably 20 μm or more and 60 μm or less, and more preferably 35 μm or more and 50 μm or less.

The produced substrate is preferably wound up in a roll around a core before forming the ink-receiving layer. The diameter of the core is preferably 50 mm or more and 300 mm or less. The tension at the time of winding is preferably 50 N/m or more and 800 N/m or less. The tension at the time of winding may be constant from the beginning to the end of winding, or may be gradually reduced from the beginning to the end of winding to reduce the pressure concentration at the beginning of winding.

(Ink-Receiving Layer)

[Inorganic Particles]

The ink-receiving layer preferably contains inorganic particles. The average primary particle diameter of the inorganic particles is preferably 50 nm or less, more preferably 1 nm or more and 30 nm or less, and particularly preferably 3 nm or more and 10 nm or less. The average primary particle diameter of the inorganic particles is the number average (average value of 100 or more points) of the diameter of a circle having an area equal to the projected area of the primary particles of the inorganic particles when observed with an electron microscope.

The content (% by mass) of the inorganic particles in the ink-receiving layer is preferably 50.0% by mass or more and 98.0% by mass or less, and more preferably 70.0% by mass or more and 96.0% by mass or less based on the total mass of the ink-receiving layer.

The ink-receiving layer can be formed, for example, by preparing a coating liquid containing a material contained in the ink-receiving layer, and applying and drying the prepared coating liquid. The inorganic particles are preferably used in a coating liquid for an ink-receiving layer in a state of being dispersed by a dispersant. The average secondary particle diameter of the inorganic particles in a dispersed state is preferably 0.1 nm or more and 500 nm or less, more preferably 1 nm or more and 300 nm or less, and particularly preferably 10 nm or more and 250 nm or less. The average secondary particle diameter of the inorganic particles in a dispersed state can be measured by a dynamic light scattering method.

The coating amount ($g/m^2$) of the inorganic particles applied when forming the ink-receiving layer is preferably 8 $g/m^2$ or more and 45 $g/m^2$ or less. By setting the coating amount of the inorganic particles within the above range, an ink-receiving layer having a preferable film thickness can be easily formed.

Examples of inorganic particles include alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. Among them, silica, alumina, and alumina hydrate which can form a porous structure excellent in ink absorption are preferable.

[1] Silica

Silica is roughly classified into a wet method and a dry method (gas phase method) according to a production method of the silica. As a wet method, there is known a method in which active silica produced by acid decomposition of a silicate is appropriately polymerized and aggregated and precipitated to obtain hydrated silica. On the other hand, as a dry method (gas phase method), there is known a method of obtaining anhydrous silica by a method using high-temperature gas phase hydrolysis of silicon halide (flame hydrolysis method) or a method in which silica sand and coke are heat-reduced and vaporized by an arc in an electric furnace and then oxidized with air (arc method).

Among them, it is preferable to use silica (fumed silica) obtained by a dry method (gas phase method). Since fumed silica has a particularly large specific surface area, the ink absorption can be improved. In addition, since fumed silica has a low refractive index, the transparency of the ink-receiving layer can be increased, and the coloring property of an image can be further improved. Examples of commercially available fumed silica include, under the following trade names, Aerosil (manufactured by Evonik Japan Co., Ltd.) and Reolosil QS type (manufactured by Tokuyama Corporation).

The specific surface area of the fumed silica calculated by the BET method is preferably 50 $m^2/g$ or more and 400 $m^2/g$ or less, and more preferably 200 $m^2/g$ or more and 350 $m^2/g$ or less. The BET method is a type of a powder surface area measurement method using a gas phase adsorption method, and is a method of obtaining the total surface area of a 1 g sample, that is, the specific surface area, from an adsorption isotherm. In the BET method, nitrogen gas is generally used as an adsorption gas, and a method of measuring the amount of adsorption from a change in pressure or volume of the gas to be adsorbed is most often used. At this time, Brunauer, Emmett, and Teller's equations, which are most prominent as representations of isotherms of multimolecular adsorption, are called BET equations, and are widely used for determination of specific surface area. In the BET method, the specific surface area can be obtained by calculating the amount of adsorption based on the BET equation and multiplying the area occupied by one adsorbed molecule on the surface. In the BET method, in the measurement of the nitrogen adsorption and desorption method, the specific surface area is derived by measuring the relationship between a certain relative pressure and the amount of adsorption at several points and obtaining the slope and intercept of the plot by the least square method. In the present disclosure, the relationship between the relative pressure and the amount of adsorption is measured at five points to derive the specific surface area.

The fumed silica preferably used in a coating liquid for an ink-receiving layer in a state of being dispersed by a dispersant.

[2] Alumina

Examples of the alumina include γ-alumina, α-alumina, δ-alumina, θ-alumina, and χ-alumina. Among them, γ-alumina is preferable from the viewpoint of the optical density of an image and the ink absorption. As γ-alumina, fumed alumina is preferably used. Examples of commercially available fumed alumina include, under the following trade names, AEROXIDE; Alu C, Alu 130, and Alu 65 (all manufactured by EVONIK Industries).

The specific surface area of the fumed alumina calculated by the BET method is preferably 50 $m^2/g$ or more and 150 $m^2/g$ or less, and more preferably 80 $m^2/g$ or more and 120 $m^2/g$ or less.

[3] Alumina Hydrate

The alumina hydrate is preferably represented by the following general formula (X).

$$Al_2O_{3-n}(OH)_{2n}.mH_2O \quad (X)$$

In the general formula (X), n is an integer of 0 to 3, and m is 0 to 10, preferably 0 to 5. Here, there is no case where m and n are simultaneously 0. $mH_2O$ often represents a detachable aqueous phase that does not participate in the formation of a crystal lattice. Therefore, m need not be an integer. When the alumina hydrate is heated, m may become zero.

The crystal structure of the alumina hydrate includes amorphous, gibbsite, boehmite types, and the like depending on the temperature of the heat treatment. The crystal structure of alumina hydrate can be analyzed by X-ray diffraction. As the alumina hydrate, boehmite-type alumina hydrate or amorphous alumina hydrate is preferable. Specific examples of the alumina hydrate include alumina hydrate described in Japanese Patent Application Laid-Open No. H07-232473, Japanese Patent Application Laid-Open No. H08-132731, Japanese Patent Application Laid-Open No. H09-66664, and Japanese Patent Application Laid-Open No. H09-76628. Examples of commercially available alumina hydrate include, under the following trade names, Disperal HP14 (manufactured by Sasol Limited).

The alumina hydrate is preferably a plate-like alumina hydrate having an aspect ratio of 2 or more. The aspect ratio of the sheet-like alumina hydrate can be determined by the method described in Japanese Patent Application Laid-Open No. H05-16015. That is, the aspect ratio is represented by the ratio of "diameter" to "thickness" of the particle. "Diameter" is the diameter (equivalent circle diameter) of a circle having an area equal to the projected area of the particles when the alumina hydrate is observed with an electron microscope.

The specific surface area of the alumina hydrate calculated by the BET method is preferably 100 $m^2/g$ or more and 200 $m^2/g$ or less, and more preferably 125 $m^2/g$ or more and 175 $m^2/g$ or less.

The alumina hydrate can be produced by a known method such as a method of hydrolyzing aluminum alkoxide or a method of hydrolyzing sodium aluminate as described in U.S. Pat. Nos. 4,242,271 and 4,202,870. The alumina hydrate can also be produced by a known method such as a method of adding an aqueous solution of aluminum sulfate or aluminum chloride to an aqueous solution of sodium aluminate or the like to neutralize the aqueous solution as described in Japanese Patent Application Laid-Open No. S57-44605.

The alumina hydrate and alumina are preferably mixed with the coating liquid for the ink-receiving layer in the form of an aqueous dispersion dispersed by a dispersant, and it is preferable to use an acid as the dispersant. As the acid, it is preferable to use a sulfonic acid represented by the following general formula (Y) because an effect of suppressing blurring of an image can be obtained.

$$R—SO_3H \quad (Y)$$

In the general formula (Y), R represents a hydrogen atom, an alkyl group having 1 to 4 carbon atoms, or an alkenyl group having 1 to 4 carbon atoms. R may be substituted with an oxo group, a halogen atom, an alkoxy group, and an acyl group. The content of the acid is preferably 1.0% by mass or more and 2.0% by mass or less, and more preferably 1.3% by mass or more and 1.6% by mass or less with respect to the total content of alumina hydrate and alumina.

[Binder]

The ink-receiving layer preferably contains a binder. The binder is a material capable of binding inorganic particles to form a film. The content of the binder in the ink-receiving layer is preferably 50.0% by mass or less, and more preferably 30.0% by mass or less, from the viewpoint of ink absorption. The content of the binder in the ink-receiving layer is preferably 5.0% by mass or more, and more preferably 8.0% by mass or more with respect to the content of the inorganic particles, from the viewpoint of the binding property of the ink-receiving layer.

Examples of the binder include starch derivatives such as oxidized starch, etherified starch, and phosphated starch; cellulose derivatives such as carboxymethylcellulose and hydroxyethylcellulose; casein, gelatin, soy protein, polyvinyl alcohol, and derivatives thereof; conjugated polymer latexes such as polyvinylpyrrolidone, a maleic anhydride resin, a styrene-butadiene copolymer, and a methyl methacrylate-butadiene copolymer; acrylic polymer latexes such as polymer of acrylate and methacrylate; a vinyl polymer latex such as an ethylene-vinyl acetate copolymer; a functional group-modified polymer latex with a monomer containing a functional group such as a carboxy group of the above polymer; a material obtained by cationizing the above polymer using a cationic group; a material obtained by cationizing the surface of the above polymer using a cationic surfactant; a material obtained by polymerizing monomers constituting the above polymer under cationic polyvinyl alcohol and distributing polyvinyl alcohol on the surface of the polymer; a material obtained by polymerizing monomers constituting the above polymer in a suspension dispersion of cationic colloid particles and distributing the cationic colloid particles on the surface of the polymer; aqueous binders such as thermosetting synthetic resins such as a melamine resin and a urea resin; polymers and copolymers of acrylates and methacrylates such as polymethyl methacrylate; and synthetic resins such as a polyurethane resin, an unsaturated polyester resin, a vinyl chloride-vinyl acetate copolymer, polyvinyl butyral, and an alkyd resin.

Among them, it is preferable to use polyvinyl alcohol (PVA) or a polyvinyl alcohol derivative (PVA derivative) as a binder. Examples of the PVA derivative include cation-modified PVA, anion-modified PVA, silanol-modified PVA, and polyvinyl acetal. As the cation-modified PVA, for example, those having an amino group in the main chain or side chain of polyvinyl alcohol as described in Japanese Patent Application Laid-Open No. S61-10483 are preferable.

The polyvinyl alcohol can be synthesized by saponifying polyvinyl acetate. The degree of saponification of polyvinyl alcohol is preferably 80.0 mol % or more and 100.0 mol % or less, and more preferably 85.0 mol % or more and 98.0 mol % or less. The degree of saponification of polyvinyl alcohol is a ratio (mol %) of the hydroxy group to the total of the acetyloxy group and the hydroxy group in the polyvinyl alcohol. The degree of saponification of polyvinyl alcohol in the present specification is a value measured by a method in accordance with JIS K 6726: 1994.

The degree of polymerization of polyvinyl alcohol is preferably 2,000 or more, and more preferably 2,000 or more and 5,000 or less. The degree of polymerization of polyvinyl alcohol in the present specification is a viscosity average degree of polymerization measured by a method in accordance with JIS K 6726: 1994.

In preparing the coating liquid for the ink-receiving layer, it is preferable to use polyvinyl alcohol or a polyvinyl alcohol derivative in the form of an aqueous solution. The content of the solid content of polyvinyl alcohol and the polyvinyl alcohol derivative in the aqueous solution is preferably 3.0% by mass or more and 20.0% by mass or less based on the total mass of the aqueous solution.

[Crosslinking Agent]

The ink-receiving layer preferably contains a crosslinking agent. Examples of the crosslinking agent include an aldehyde compound, a melamine compound, an isocyanate compound, a zirconium compound, an amide compound, an aluminum compound, boric acid, and borate. When using polyvinyl alcohol or a polyvinyl alcohol derivative as a binder, boric acid or borate is preferably used as a crosslinking agent.

Examples of boric acid include orthoboric acid (H3B03), metaboric acid, and diboric acid. As the borate, a water-soluble salt of boric acid is preferable. Examples of the water-soluble salts of boric acid include alkali metal salts of boric acid such as sodium and potassium salts of boric acid; alkaline earth metal salts of boric acid such as magnesium and calcium salts of boric acid; and ammonium salts of boric acid. Among them, the use of orthoboric acid is preferred because the temporal stability of the coating liquid is improved and the occurrence of cracks is suppressed.

The amount of the crosslinking agent can be appropriately adjusted according to the production conditions and the like. The content of the crosslinking agent in the ink-receiving layer is preferably 1.0% by mass or more and 50.0% by mass or less, and more preferably 5.0% by mass or more and 40.0% by mass or less with respect to the content of the binder.

It is assumed that the binder is polyvinyl alcohol and the crosslinking agent is at least one of boric acid and borate. In such a case, the total content of boric acid and borate with respect to the content of polyvinyl alcohol in the ink-receiving layer is preferably 5.0% by mass or more and 30.0% by mass or less.

[Other Additives]

The ink-receiving layer may contain other additives other than the various components described above. Examples of other additives include a pH adjuster, a thickener, a flow improver, an antifoaming agent, a foam suppressor, a surfactant, a release agent, a penetrant, a coloring pigment, a coloring dye, a fluorescent brightener, an ultraviolet inhibitor, an antioxidant, a preservative, a fungicide, a waterproofing agent, a dye fixing agent, a curing agent, and a weather resistant material.

(Bonding Layer)

The recording medium includes a bonding layer disposed on the resin layer. That is, the bonding layer is disposed between the resin layer of the substrate and the ink-receiving layer. By disposing the bonding layer, the adhesion between the substrate (resin layer) and the ink-receiving layer can be improved.

The bonding layer usually contains a resin. Examples of the resin used for the bonding layer include polyester, polyolefin, polyurethane, acrylic, styrene-acryl, ethylene-vinyl acetate, polyvinyl alcohol, and gelatin. Among them, a polyester resin, a polyolefin resin, a urethane resin, and an acrylic resin are preferable from the viewpoint of the mixability of the ultraviolet inhibitor contained in the bonding layer, and a polyester resin and a polyolefin resin are more preferable from the viewpoint of the adhesion between the substrate and the ink-receiving layer. In addition, from the viewpoint of cutting processability of the recording medium, the bonding layer preferably contains a resin having a glass transition temperature of 30° C. or less.

The resin can be used in the form of a water-dispersible emulsion or a resin solution. From the viewpoint of light fastness of the image, the thickness of the bonding layer is preferably 0.3 μm or more, more preferably 0.4 μm or more, still more preferably 0.8 μm or more, and particularly preferably 1.2 μm or more. On the other hand, even if the thickness of the bonding layer exceeds 10 μm, the desired effect is not impaired. However, the effect of improving the light fastness is likely to be saturated, and the image clarity of the recording medium is likely to be slightly reduced, which may be disadvantageous in terms of cost. In addition to the above, it is preferable that the bonding layer does not substantially absorb ink such that the influence of the color of the ultraviolet inhibitor per se contained in the bonding layer can be minimized. In order to suppress the ink absorbing property of the bonding layer, the resin content in the bonding layer is preferably 55% by mass or more, more preferably 65% by mass or more, based on the total mass of the bonding layer.

[Ultraviolet Inhibitor]

The bonding layer contains an ultraviolet inhibitor. The ultraviolet inhibitor is not particularly limited as long as it can absorb or scatter ultraviolet rays. That is, the ultraviolet inhibitor is at least one selected from the group consisting of an ultraviolet absorber and an ultraviolet scattering agent. The content (% by mass) of the ultraviolet inhibitor in the bonding layer is 5.0% by mass or more and 35.0% by mass or less, and preferably 7.0% by mass or more and 35.0% by mass or less based on the total mass of the bonding layer. The content of the ultraviolet inhibitor in the bonding layer is more preferably 10.0% by mass or more and 35.0% by mass or less, and particularly preferably 20.0% by mass or more and 35.0% by mass or less.

The ultraviolet inhibitor is classified into, for example, an inorganic ultraviolet inhibitor and an organic ultraviolet inhibitor. The inorganic ultraviolet inhibitor is an ultraviolet scattering agent which generally scatters ultraviolet rays. Examples of the inorganic ultraviolet inhibitor include zinc oxide, titanium dioxide, and cerium oxide. The content of the inorganic ultraviolet inhibitor in the bonding layer is preferably 3 parts by mass or more and 20 parts by mass or less, and more preferably 5 parts by mass or more and 20 parts by mass or less with respect to 100 parts by mass of the resin used for the bonding layer. When the content of the inorganic ultraviolet inhibitor in the bonding layer is less than 3 parts by mass, the effect of improving light fastness may be insufficient. On the other hand, when the content of the inorganic ultraviolet inhibitor in the bonding layer is more than 20 parts by mass, the adhesion between the substrate and the ink-receiving layer may be easily reduced.

The organic ultraviolet inhibitor is an ultraviolet absorber which generally absorbs ultraviolet rays. Examples of the organic ultraviolet inhibitor include benzotriazole compounds, benzophenone compounds, triazine compounds, dibenzoylmethane compounds, para-aminobenzoic acid compounds, methoxycinnamic acid compounds, salicylic acid compounds, and cyanoacrylate compounds. The content of the organic ultraviolet inhibitor in the bonding layer is preferably 10 parts by mass or more and 50 parts by mass or less, and more preferably 20 parts by mass or more and 50 parts by mass or less with respect to 100 parts by mass of the resin used for the bonding layer. When the content of the organic ultraviolet inhibitor in the bonding layer is less than 10 parts by mass, the effect of improving light fastness may be insufficient. On the other hand, when the content of the organic ultraviolet inhibitor in the bonding layer is more than 50 parts by mass, the adhesion between the substrate and the ink-receiving layer may be easily reduced.

The ultraviolet inhibitor is preferably at least one selected from the group consisting of titanium dioxide, a benzotriazole compound, and a triazine compound, and more preferably at least one of titanium dioxide and a benzotriazole compound. Among them, titanium dioxide is particularly preferable. In particular, titanium dioxide can also suppress the directivity of reflected light. In addition, from the viewpoint of coloring property of an image, rutile-type titanium oxide is preferable as titanium dioxide. When an organic ultraviolet inhibitor and an inorganic ultraviolet inhibitor are used in combination, the total amount of the ultraviolet inhibitor is preferably 50 parts by mass or less, and more preferably 45 parts by mass or less with respect to 100 parts by mass of the resin used for the bonding layer, from the viewpoint of the adhesion between the substrate and the ink-receiving layer.

(Back Coat Layer)

It is preferable to provide a back coat layer on the surface of the substrate opposite to the surface on which the ink-receiving layer is provided, in order to improve handling properties, transport suitability, and transport abrasion resistance during continuous printing with a large number of sheets stacked. The back coat layer preferably contains a white pigment, a binder, and the like. The thickness of the back coat layer is preferably 1 $g/m^2$ or more and 25 $g/m^2$ or less in a dry coating amount.

(Method of Forming Ink-Receiving Layer)

After forming a bonding layer on the resin layer of the substrate, an ink-receiving layer is formed by applying and drying a coating liquid for an ink-receiving layer on the bonding layer to obtain the target recording medium. The coating liquid can be applied using a curtain coater, a coater using an extrusion method, a coater using a slide hopper method, or the like. The coating liquid may be heated during coating. As a drying method after coating, there is a method of using a hot air dryer such as a straight tunnel dryer, an arch dryer, an air loop dryer, and a sine curve air float dryer. Further, there is a method of using a dryer using infrared rays, a heating dryer, microwaves, or the like.

According to the present disclosure, it is possible to provide an inkjet recording medium capable of recording an image with excellent coloring property and light fastness, and with excellent image clarity and cutting processability.

Example

Hereinafter, the present disclosure will be described in more detail with reference to Examples and Comparative Examples, but the present invention is not limited to the following Examples unless it exceeds the gist thereof. Components described as "parts" and "%" are based on mass unless otherwise specified.

<Preparation of Inorganic Particle Dispersion>

(Inorganic Particle Dispersion 1)

2 parts of methanesulfonic acid was dissolved in 498 parts of ion exchange water to obtain a methanesulfonic acid aqueous solution. While stirring the obtained methanesulfonic acid aqueous solution at 3,000 rpm using a dispersing machine (trade name "Homomixer MARK II 2.5", manufactured by PRIMIX Corporation), 100 parts of alumina hydrate (trade name "DISPERAL HP14", manufactured by Sasol Limited) was added little by little. After completion of the addition of the alumina hydrate, the mixture was further stirred for 30 minutes to obtain an inorganic particle dispersion 1 having a solid content of 23.0%.

(Inorganic Particle Dispersion 2)

4.0 parts of a cationic resin (trade name "SHALLOL DC902P", manufactured by DKS Co. Ltd.) was dissolved in 333 parts of ion exchange water to obtain an aqueous solution of the cationic resin. While stirring the obtained aqueous solution of the cationic resin at 3,000 rpm using a dispersing machine, 100 parts of fumed silica was added little by little. As the fumed silica, a trade name "AEROSIL300" (manufactured by EVONIK Industries) was used. After completion of the addition of the fumed silica, the mixture was diluted with ion exchange water. The treatment was performed twice using a high-pressure homogenizer (trade name "Nanomizer", manufactured by YOSHIDA KIKAI CO., LTD.) to obtain an inorganic particle dispersion 2 having a solid content of 20.0%.

(Inorganic Particle Dispersion 3)

5.0 parts of a cationic resin (trade name "SHALLOL DC902P", manufactured by DKS Co. Ltd.) was dissolved in 420 parts of ion exchange water to obtain an aqueous solution of the cationic resin. While stirring the obtained aqueous solution of the cationic resin at 3,000 rpm using a dispersing machine, wet silica (trade name "HP39", manufactured by PQ Corporation) was added little by little. After completion of the addition of the wet silica, the mixture was further stirred for 30 minutes to obtain an inorganic particle dispersion 3 having a solid content of 20.0%.

<Preparation of Coating Liquid for Ink-Receiving Layer>

The prepared inorganic particle dispersion, an aqueous solution of polyvinyl alcohol (trade name "PVA235", manufactured by KURARAY Co., Ltd.), an aqueous solution of orthoboric acid, and an ultraviolet inhibitor were mixed so as to have a solid content shown in Table 1, and coating liquids A1 to A5 for an ink-receiving layer were obtained.

TABLE 1

Composition of coating liquid for ink-receiving layer

| Coating liquid layer for ink-receiving layer | Inorganic particle dispersion | | | Content (parts) of polyvinyl alcohol | Content (parts) of orthoboric acid | Ultraviolet inhibitor | |
|---|---|---|---|---|---|---|---|
| | Type | Inorganic particles | Content* (parts) | | | Type | Content (parts) |
| A1 | 1 | Alumina hydrate | 100 | 10 | 1 | — | — |
| A2 | 2 | Fumed silica | 100 | 23 | 3 | — | — |
| A3 | 3 | Wet silica | 100 | 50 | 0 | — | — |
| A4 | 1 | Alumina hydrate | 100 | 10 | 1 | Hostavin3326 | 2 |
| A5 | 1 | Alumina hydrate | 100 | 10 | 1 | Titanium dioxide | 2 |

*Solid content of inorganic particles

<Production of Substrate>

(Substrate S1)

A resin composition containing 40 parts of low-density polyethylene (LDPE) and 60 parts of high-density polyethylene (HDPE) was applied on the back surface of a base paper (trade name "OK Kanto+127.9", OJI PAPER, with a coating layer) so that the dry coating amount was 40 g/m$^2$ to form a back surface resin layer. The surface on which the back surface resin layer was formed is defined as the back surface of the substrate. Further, on the surface of the base paper, low-density polyethylene (LDPE) was extrusion-laminated to a dry coating amount of 20 g/m$^2$ to form an intermediate layer, and at the same time, a PET film was bonded to form a resin layer, and a substrate S1 was obtained. As the PET film, a trade name "Melinex 329" (manufactured by Dupont Teijin Films) which is a biaxially stretched polyester film was used. The 20° glossiness of the surface of the substrate (the surface of the resin layer) measured using a gloss meter (trade name "VG7000", manufactured by NIPPON DENSHOKU INDUSTRIES) in accordance with JIS Z 8741: 1997 was 38.3. The Wb value of the surface of the substrate (the surface of the resin layer) measured using a DOI measuring device (trade name "Wave-Scan", manufactured by Tetsutani) was 8.2.

(Substrate S2)

A substrate S2 was obtained in the same manner as in the case of the substrate S1 except that the resin layer, the intermediate layer, and the base paper of the types shown in Table 2 were used. Table 2 shows the 20° glossiness of the surface of the substrate S2 (the surface of the resin layer). The PET film (Melinex 330) is a biaxially stretched polyester film.

(Substrate S3)

A PET film (trade name "Melinex 331", manufactured by Dupont Teijin Films) which is a biaxially stretched polyester film was used as a substrate S3 as it was. Table 2 shows the 20° glossiness of the surface of the substrate S3 (the surface of the resin layer).

(Substrate S4)

Low-density polyethylene (LDPE) and a PET film (trade name "Unstretched PET Novaclear", manufactured by Mitsubishi Chemical Corporation) were bonded to obtain a substrate S4. Table 2 shows the 20° glossiness of the surface of the substrate S4 (the surface of the resin layer).

(Substrate S5)

Low-density polyethylene (LDPE) and a PP film (trade name "Unilax RT-680CA", manufactured by Idemitsu Kosan) were bonded to obtain a substrate S5. Table 2 shows the 20° glossiness of the surface of the substrate S5 (the surface of the resin layer).

(Substrate S6)

A substrate S6 was obtained in the same manner as in the case of the substrate S1 except that the resin layer, the intermediate layer, and the base paper of the types shown in Table 2 were used. Table 2 shows the 20° glossiness of the surface of the substrate S6 (the surface of the resin layer). The PP film (trade name "PYLEN Film-OT P2161", manufactured by TOYOBO) is a biaxially stretched polypropylene film.

(Substrate S7)

A base paper (trade name "OK Prince High quality", manufactured by OJI PAPER) was used as the substrate S7. The 20° glossiness and Wb value of the substrate S7 could not be measured.

TABLE 2

| Configuration of substrate | | | | | | |
|---|---|---|---|---|---|---|
| | Resin layer | | | | | Intermediate layer |
| Substrate | Trade name | Manufacturer | Manufacturing method | Thickness (μm) | Resin type | Resin type |
| S1 | Melinex 329 | Dupont Teijin Films | Stretched | 100 | PET | LDPE |
| S2 | Melinex 330 | Dupont Teijin Films | Stretched | 100 | PET | LDPE |
| S3 | Melinex 331 | Dupont Teijin Films | Stretched | 200 | PET | — |
| S4 | Unstretched PET Novaclear | Mitsubishi Chemical Corporation | Cast | 200 | PET | LDPE |
| S5 | Unilax RT-680CA | Idemitsu Kosan | Cast | 70 | PP | LDPE |
| S6 | PYLEN Film-OT P2161 | TOYOBO | Stretched | 20 | PP | LDPE |
| S7 | — | — | — | — | — | — |

| | Base paper | | | | | Wb of the surface |
|---|---|---|---|---|---|---|
| Substrate | Trade name | Manufacturer | Presence or absence of coating layer | Thickness (μm) | 20° glossiness | of the resin layer |
| S1 | OK Kanto + 127.9 | OJI PAPER | Presence | 100 | 38.3 | 8.2 |
| S2 | OK Prince High quality 127.9 | OJI PAPER | Absence | 152 | 34.3 | 12.2 |
| S3 | — | — | — | — | 45.3 | 5.2 |
| S4 | — | — | — | — | 38.6 | 19.3 |
| S5 | — | — | — | — | 43.2 | 23.0 |
| S6 | OK Prince High quality 127.9 | OJI PAPER | Absence | 152 | 31.1 | 54.8 |
| S7 | OK Prince High quality 127.9 | OJI PAPER | Absence | 152 | — | — |

<Preparation of Coating Liquid for Bonding Layer>

Bonding layer resins of the type shown in Table 3 and ultraviolet inhibitors of the type shown in Table 4 were prepared. Then, the bonding layer resins and the ultraviolet inhibitors prepared so as to have the types and amounts shown in Table 5 were mixed to prepare coating liquids P1 to P22 for the bonding layer.

TABLE 3

| Type of bonding layer resin | | | | |
|---|---|---|---|---|
| Bonding layer resin | Trade name | Manufacturer | Type of resin | Glass transition temperature (° C.) |
| B1 | Vylonal MD1480 | TOYOBO | Polyester | 20 |
| B2 | Elitel KT-8904 | UNITIKA LTD. | Polyester | 8 |
| B3 | Elitel KT-9204 | UNITIKA LTD. | Polyester | 18 |
| B4 | Arrowbase SB-1200 | UNITIKA LTD. | Polyolefin | −30 |
| B5 | Hydran WLS210 | DIC | Urethane | −15 |

TABLE 3-continued

| Type of bonding layer resin | | | | |
|---|---|---|---|---|
| Bonding layer resin | Trade name | Manufacturer | Type of resin | Glass transition temperature (° C.) |
| B6 | Movinyl DM774 | Japan Coating Resin co., ltd. | Acrylic | 13 |

TABLE 4

| Type of ultraviolet inhibitor | | | |
|---|---|---|---|
| Ultraviolet inhibitor | Trade name | Manufacturer | Type |
| C1 | Hostavin3326 | Clariant | Benzotriazole compound |
| C2 | SHINEGUARD BZ-24 | SENKA corporation | Benzotriazole compound |
| C3 | SHINEGUARD TA-22 | SENKA corporation | Triazine compound |
| C4 | POLLUX WHITE PC-CRH | Sumika Color CO., Ltd. | Rutile-type titanium dioxide |

TABLE 5

| Composition of coating liquid for bonding layer | | | | | | | | |
|---|---|---|---|---|---|---|---|---|
| Coating liquid for bonding layer | Bonding layer resin | | Ultraviolet inhibitor | | | | Ultraviolet inhibitor (total) | |
| | | | Organic | | Inorganic | | | |
| | Type | Content* (parts) | Type | Content (parts) | Type | Content (parts) | Parts | % |
| P1 | B1 | 100 | C1 | 30 | — | — | 30 | 23.1 |
| P2 | | 100 | — | — | C4 | 10 | 10 | 9.1 |
| P3 | | 100 | — | — | | 20 | 20 | 16.7 |
| P4 | | 100 | C1 | 50 | — | — | 50 | 33.3 |
| P5 | | 100 | | 11.1 | — | — | 11.1 | 10.0 |
| P6 | | 100 | | 10 | C4 | 3 | 13 | 11.5 |
| P7 | | 100 | | 20 | | 10 | 30 | 23.1 |
| P8 | | 100 | | 30 | | 10 | 40 | 28.6 |
| P9 | | 100 | | 30 | | 20 | 50 | 33.3 |
| P10 | | 100 | | 30 | — | — | 30 | 23.1 |
| P11 | B2 | 100 | | 30 | — | — | 30 | 23.1 |
| P12 | B3 | 100 | | 30 | — | — | 30 | 23.1 |
| P13 | B4 | 100 | | 30 | — | — | 30 | 23.1 |
| P14 | B5 | 100 | | 30 | — | — | 30 | 23.1 |
| P15 | B6 | 100 | | 30 | — | — | 30 | 23.1 |
| P16 | B1 | 100 | C2 | 30 | — | — | 30 | 23.1 |
| P17 | | 100 | C3 | 30 | — | — | 30 | 23.1 |
| P18 | | 100 | — | — | — | — | 0 | 0.0 |
| P19 | | 100 | — | — | C4 | 3 | 3 | 2.9 |
| P20 | | 100 | — | — | | 60 | 60 | 37.5 |
| P21 | | 100 | C1 | 3 | — | — | 3 | 2.9 |
| P22 | | 100 | | 60 | — | — | 60 | 37.5 |
| P23 | | 100 | | 5.3 | — | — | 5.3 | 5.0 |
| P24 | | 100 | | 53.8 | — | — | 53.8 | 35.0 |

*Solid content

<Manufacture of Recording Medium>

The coating liquid for the bonding layer was applied to each substrate using a coating apparatus having a bar coater, and dried with hot air at 100° C. to provide the bonding layer on the substrate. Thereafter, using a slide hopper type coating apparatus, a coating liquid for an ink-receiving layer was applied to the substrate provided with the bonding layer. The ink-receiving layer was formed on the bonding layer by drying with hot air at 120° C. to obtain a recording medium. Table 6 shows combinations of the substrate, the coating liquid for the ink-receiving layer, and the coating liquid for the bonding layer used, and the thickness of the formed bonding layer. The thickness of each of the ink-receiving layers was set to 30 μm. Then, after performing the evaluation described in the below, the recording medium was washed with water and the ink-receiving layer was removed. The resulting laminate having the substrate and the bonding layer was subjected to the measurement of Wb value with respect to the surface of the bonding layer in the same manner as the measurement of Wb value with respect to the resin layer before forming the bonding layer. As a result, it was confirmed that the Wb value of the surface of the bonding layer was the same as the Wb value of the resin layer before formation of the bonding layer.

<Evaluation>

(20° Glossiness of Surface on Ink-Receiving Layer Side)

The 20° glossiness of the surface on the ink-receiving layer side of the recording medium was measured using a gloss meter (trade name "VG7000", manufactured by NIPPON DENSHOKU INDUSTRIES) in accordance with JIS Z 8741: 1997. The results are shown in Table 6.

(Image Clarity)

Using an image clarity measuring device (trade name "ICM-1", manufactured by Suga Test Instruments), the image clarity of the surface of the recording medium on the ink-receiving layer side was measured by an image clarity test method according to JIS H 8686-2, and evaluated according to the following evaluation criteria. The results are shown in Table 6. In the following evaluation criteria, "3" or more was set as a preferable range. The conditions of the image clarity test method are shown below.

[Conditions of Image Clarity Test Method]

Measurement method: Reflection

Measurement angle (incident angle, light receiving angle): 60°

Optical comb: 2.0 mm

[Evaluation Criteria of Image Clarity]

5: The image clarity was 80% or more.

4: The image clarity was 75% or more and less than 80%.

3: The image clarity was 70% or more and less than 75%.

2: The image clarity was 65% or more and less than 70%.

1: The image clarity was less than 65% or more.

(Coloring Property of Image)

Using an inkjet recording apparatus (trade name "TS9030", manufactured by Canon Inc.), a solid black image was recorded on the surface of the recording medium on the ink-receiving layer side in "Glossy Pro Platinum Grade" and "no color correction mode". The optical density of the recorded solid image was measured using an optical reflection densitometer (trade name "530 Spectral Densitometer", manufactured by X-Rite, Incorporated), and the coloring property of the image was evaluated according to the following evaluation criteria. The results are shown in Table 6. In the following evaluation criteria, it was determined that there was no practical problem if the evaluation was "3" or more.

[Evaluation criteria of coloring property]

5: The optical density was 2.40 or more.

4: The optical density was 2.35 or more and less than 2.40.

3: The optical density was 2.30 or more and less than 2.35.

2: The optical density was 2.25 or more and less than 2.30.

1: The optical density was less than 2.25.

(Light Fastness of Image)

Using an inkjet recording apparatus (trade name "imagePROGRAF PRO-1000", manufactured by Canon Inc.), a yellow tone patch was recorded on the surface of the recording medium on the ink-receiving layer side in "Glossy Pro Platinum Grade" and "standard mode". The optical density of the recorded tone patch was measured using an optical reflection densitometer (trade name "530 Spectral Densitometer", manufactured by X-Rite, Incorporated). Then, using a super xenon weather meter (trade name "SX120", manufactured by Suga Test Instruments Co., Ltd.), a light fastness test was performed by irradiating a patch with an optical density of 0.5 with an illuminance of 150 klx·h for 360 hours. The optical density of the patch after the light fastness test was measured, the residual ratio of the optical density was calculated by the following equation (2), and the light fastness of the image was evaluated according to the following evaluation criteria. The results are shown in Table 6. In the following evaluation criteria, it was determined that there was no practical problem if the evaluation was "3" or more.

$$R=(OD_1/OD_2)\times 100 \quad (2)$$

R: Residual ratio of optical density (%)

$OD_1$: Optical density after light fastness test $OD_2$: Optical density before light fastness test

[Evaluation Criteria of Light Fastness]

5: The residual ratio of the optical density was 85% or more.

4: The residual ratio of the optical density was 80% or more and less than 85%.

3: The residual ratio of the optical density was 75% or more and less than 80%.

2: The residual ratio of the optical density was 70% or more and less than 75%.

1: The residual ratio of the optical density was less than 70%.

(Cutting Processability (Adhesion))

The recording medium (A4 size) was cut 20 times along the short stitch direction using an NT cutter. The paper powder generated by the cutting was collected, the mass was measured, and the cutting processability (adhesion) was evaluated according to the following evaluation criteria. In the following criteria, it was determined that there was no practical problem if the evaluation was "4" or more.

[Evaluation Criteria of Cutting Processability (Adhesion)]

5: The mass of the paper power was less than 5 mg.

4: The mass of the paper power was more than 5 mg to less than 10 mg.

3: The mass of the paper power was more than 10 mg to less than 20 mg.

2: The mass of the paper power was more than 20 mg to less than 30 mg.

1: The mass of the paper power was 30 mg or more.

TABLE 6

| Configuration of recording medium and evaluation result | | | | | | | | | | |
|---|---|---|---|---|---|---|---|---|---|---|
| | | Coating | Bonding layer | | | | | | | |
| | | liquid | Coating | | Content | | Evaluation | | | |
| | Substrate | for ink-receiving layer | liquid for bonding layer | Thickness (μm) | (%) of ultraviolet inhibitor | 20° glossiness of surface | Image clarity | Coloring property of image | Light fastness of image | Cutting processability (adhesion) |
| Example 1 | S1 | A1 | P1 | 1.2 | 23.1 | 40.2 | 5 | 5 | 5 | 5 |
| Example 2 | S2 | A1 | P1 | 1.2 | 23.1 | 38.2 | 4 | 5 | 5 | 5 |
| Example 3 | S3 | A1 | P1 | 1.2 | 23.1 | 50.3 | 5 | 5 | 5 | 5 |
| Example 4 | S4 | A1 | P1 | 1.2 | 23.1 | 26.3 | 3 | 5 | 5 | 5 |
| Example 5 | S5 | A1 | P1 | 1.2 | 23.1 | 22.4 | 3 | 5 | 5 | 5 |
| Example 6 | S1 | A1 | P1 | 5.0 | 23.1 | 36.1 | 3 | 5 | 5 | 5 |
| Example 7 | S1 | A1 | P1 | 1.0 | 23.1 | 38.1 | 5 | 5 | 4 | 5 |
| Example 8 | S1 | A1 | P1 | 0.4 | 23.1 | 39.6 | 5 | 5 | 3 | 5 |
| Example 9 | S1 | A1 | P2 | 1.2 | 9.1 | 39.4 | 5 | 5 | 4 | 5 |
| Example 10 | S1 | A1 | P3 | 1.2 | 16.7 | 38.4 | 5 | 5 | 5 | 4 |
| Example 11 | S1 | A1 | P4 | 1.2 | 33.3 | 35.6 | 5 | 5 | 5 | 4 |
| Example 12 | S1 | A1 | P5 | 1.2 | 10.0 | 37.6 | 5 | 5 | 3 | 5 |
| Example 13 | S1 | A1 | P6 | 1.2 | 11.5 | 40.5 | 5 | 5 | 3 | 5 |
| Example 14 | S1 | A1 | P7 | 1.2 | 23.1 | 39.1 | 5 | 5 | 4 | 5 |
| Example 15 | S1 | A1 | P8 | 1.2 | 28.6 | 38.1 | 5 | 5 | 5 | 5 |
| Example 16 | S1 | A1 | P9 | 1.2 | 33.3 | 37.0 | 4 | 5 | 5 | 4 |
| Example 17 | S1 | A1 | P10 | 1.2 | 23.1 | 39.8 | 5 | 5 | 5 | 5 |
| Example 18 | S1 | A1 | P11 | 1.2 | 23.1 | 37.9 | 5 | 5 | 5 | 5 |
| Example 19 | S1 | A1 | P12 | 1.2 | 23.1 | 39.7 | 5 | 5 | 5 | 5 |
| Example 20 | S1 | A1 | P13 | 1.2 | 23.1 | 40.2 | 5 | 5 | 5 | 5 |
| Example 21 | S1 | A1 | P14 | 1.2 | 23.1 | 36.8 | 5 | 5 | 5 | 4 |
| Example 22 | S1 | A1 | P15 | 1.2 | 23.1 | 38.2 | 5 | 5 | 5 | 4 |
| Example 23 | S1 | A1 | P16 | 1.2 | 23.1 | 43.1 | 5 | 5 | 5 | 5 |
| Example 24 | S1 | A1 | P17 | 1.2 | 23.1 | 42.3 | 5 | 5 | 3 | 5 |
| Example 25 | S1 | A2 | P1 | 1.2 | 23.1 | 18.1 | 5 | 4 | 5 | 5 |
| Example 26 | S6 | A1 | P1 | 1.2 | 23.1 | 13.0 | 3 | 5 | 5 | 5 |
| Example 27 | S1 | A1 | P23 | 1.2 | 5.0 | 41.2 | 5 | 5 | 3 | 5 |
| Example 28 | S1 | A1 | P24 | 1.2 | 35.0 | 40.6 | 5 | 5 | 5 | 4 |
| Comparative Example 1 | S1 | A1 | — | — | — | 42.1 | 5 | 5 | 1 | 1 |
| Comparative Example 2 | S1 | A1 | — | — | — | 38.2 | 5 | 5 | 2 | 1 |
| Comparative Example 3 | S1 | A1 | — | — | — | 45.9 | 5 | 5 | 1 | 1 |
| Comparative Example 4 | S1 | A1 | P18 | 1.2 | 0.0 | 40.5 | 5 | 5 | 1 | 5 |
| Comparative Example 5 | S1 | A1 | P1 | 0.1 | 23.1 | 41.3 | 5 | 5 | 1 | 5 |
| Comparative Example 6 | S1 | A1 | P1 | 0.2 | 23.1 | 42.0 | 5 | 5 | 2 | 5 |
| Comparative Example 7 | S1 | A1 | P19 | 1.2 | 2.9 | 39.2 | 5 | 5 | 2 | 5 |
| Comparative Example 8 | S1 | A1 | P20 | 1.2 | 37.5 | 34.6 | 4 | 5 | 5 | 2 |
| Comparative Example 9 | S1 | A1 | P21 | 1.2 | 2.9 | 42.3 | 5 | 5 | 2 | 5 |
| Comparative Example 10 | S1 | A1 | P22 | 1.2 | 37.5 | 32.1 | 5 | 5 | 5 | 3 |
| Comparative Example 11 | S1 | A3 | P1 | 1.2 | 23.1 | 0.1 | 1 | 1 | 5 | 5 |
| Comparative Example 12 | S1 | A4 | P18 | 1.2 | 0.0 | 31.5 | 3 | 2 | 5 | 5 |
| Comparative Example 13 | S1 | A5 | P18 | 1.2 | 0.0 | 16.1 | 3 | 1 | 5 | 5 |
| Comparative Example 14 | S7 | A2 | P1 | 1.2 | 23.1 | 9.2 | 1 | 5 | 5 | 3 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-089720, filed May 10, 2019, which is hereby incorporated by reference herein in its entirety.

What is claimed is:

1. An inkjet recording medium comprising a substrate having a resin layer, a bonding layer disposed on the resin layer, and an ink-receiving layer disposed on the bonding layer, wherein 20° glossiness of a surface of the inkjet recording medium on the ink-receiving layer side is 13.0 or more, the bonding layer contains an ultraviolet inhibitor, a content of the ultraviolet inhibitor in the bonding layer is 5.0% by mass or more and 35.0% by mass or less based on a total mass of the bonding layer, wherein the thickness of the bonding layer is 0.3 μm or more and 5.0 μm or less, and wherein Wb value of a surface of the resin layer on the bonding layer side measured by a distinctness of image measurement device is 0 or more and 12.2 or less.

2. The inkjet recording medium according to claim 1, wherein the content of the ultraviolet inhibitor in the bonding layer is 20.0% by mass or more and 35.0% by mass or less based on the total mass of the bonding layer.

3. The inkjet recording medium according to claim 1, wherein the thickness of the bonding layer is 0.8 μm or more and 5.0 μm or less.

4. The inkjet recording medium according to claim 1, wherein the thickness of the bonding layer is 1.2 μm or more and 5.0 μm or less.

5. The inkjet recording medium according to claim 1, wherein the ultraviolet inhibitor is at least one member selected from the group consisting of titanium dioxide, a benzotriazole compound, and a triazine compound.

6. The inkjet recording medium according to claim 1, wherein the ultraviolet inhibitor is at least one of titanium dioxide and a benzotriazole compound.

7. The inkjet recording medium according to claim 1, wherein the substrate further has a base paper.

8. The inkjet recording medium according to claim 1, wherein the resin layer is a stretched resin film.

9. The inkjet recording medium according to claim 8, wherein the stretched resin film is a biaxially stretched polyester film.

10. The inkjet recording medium according to claim 1, wherein the ink-receiving layer contains at least one inorganic particle selected from the group consisting of silica, alumina, and alumina hydrate.

11. The inkjet recording medium according to claim 1, wherein the bonding layer contains at least one resin selected from the group consisting of a polyester resin, a polyolefin resin, a urethane resin, and an acrylic resin.

12. The inkjet recording medium according to claim 1, wherein the bonding layer contains at least one of a polyester resin and a polyolefin resin.

13. The inkjet recording medium according to claim 1, wherein the bonding layer contains a resin having a glass transition temperature of 30° C. or less.

14. The inkjet recording medium according to claim 1, wherein the thickness of the resin layer is 70 μm or more.

15. The inkjet recording medium according to claim 1, wherein the thickness of the resin layer is 80 μm or more and 200 μm.

* * * * *